United States Patent [19]

Kenny

[11] Patent Number: 4,489,682

[45] Date of Patent: Dec. 25, 1984

[54] LINEAR MOVEMENT MOTOR AND A SWASH PLATE FOR A MOTOR OF THIS TYPE

[75] Inventor: James E. Kenny, Nil-St-Vincent, Belgium

[73] Assignee: S.E.C.A. Société Anonyme, Societe d'Entreprises Commerciales et Aeronautiques, Brussels, Belgium

[21] Appl. No.: 301,039

[22] Filed: Sep. 10, 1981

[30] Foreign Application Priority Data

Mar. 13, 1981 [BE] Belgium ..... 0/204121

[51] Int. Cl.[3] ..... F02B 75/04

[52] U.S. Cl. ..... 123/58 B; 123/58 BC; 123/78 F

[58] Field of Search ..... 123/58 R, 58 B, 58 BB, 123/58 BC, 48 R, 48 B, 78 R, 78 E, 78 F

[56] References Cited

U.S. PATENT DOCUMENTS

| | | | |
|---|---|---|---|
| 780,549 | 1/1905 | Callan | 123/58 BC |
| 1,857,656 | 5/1932 | Oldfield | 123/58 BC |
| 2,368,933 | 2/1945 | Lindeman | 123/58 BC |
| 2,650,676 | 9/1953 | Jamotte | 123/58 BC |
| 2,940,325 | 6/1960 | Nakesch | 123/58 B |
| 4,174,684 | 11/1979 | Roseby et al. | 123/58 BC |
| 4,285,303 | 8/1981 | Leach | 123/58 BC |
| 4,294,139 | 10/1981 | Bex et al. | 123/58 B |
| 4,394,854 | 7/1983 | Huber | 123/198 F |

*Primary Examiner*—Craig R. Feinberg

*Attorney, Agent, or Firm*—Hill, Van Santen, Steadman & Simpson

[57] ABSTRACT

The present invention relates to a motor comprising at least one piston of linear and reciprocating translational movement and a swash plate mounted at an angle on a shaft driven in rotation in an engine block by the reciprocating movements of the plate which is in contact with the piston. Each piston is integral with a rod, the end of which opposite the piston includes a slide which moves in a guide in the engine block. Each slide holds two shells which form a seat for each swivel joint of the swash plate. Preferably, the swash plate includes two or four swivel joints.

6 Claims, 9 Drawing Figures

LINEAR MOVEMENT MOTOR AND A SWASH PLATE FOR A MOTOR OF THIS TYPE

BACKGROUND OF THE INVENTION

The present invention relates to a motor or an analogous engine (hereinafter simply referred to as a motor) comprising at least one piston of linear and reciprocating translational movement and a swash plate mounted at an angle on a shaft driven in rotation in a housing or an engine block (hereinafter simply referred to as an engine block) by the reciprocating movements of said plate which is in contact with said piston.

It has already been proposed to transform the linear and reciprocating movements of one or more pistons by using a swash plate to initiate the rotation of a coupling shaft on which the relevant swash plate is secured. Examples of this type are described, among others, in U.S. Pat. Nos. 3,611,879, 3,621,761, 3,807,283 and 4,108,049 and in German Pat. No. 1,810,808.

In general, the motors or pumps according to these patents are not strong, because on the one hand, they lack means to ensure a strict linearity of the piston rods and, on the other hand, they lack compactness, generally causing excessive fatigue of the swash plate and rapid wear thereof. Any deviation in the strictly linear passage of the rods causes an ovalisation of the cylinders, whereas the lack of compactness mentioned above, coupled with a weakness of the swash plate means that an effective high power cannot be obtained.

BRIEF SUMMARY OF THE INVENTION

An essential objective of the present invention is to tend towards a slightly increased weight to power ratio, which may only be envisaged with an exceptionally strong construction of the swash plate, without departing from the compactness criterion mentioned above.

Thus, a first object of the present invention is to provide a linear movement motor comprising a swash plate of a novel and original design which is capable of withstanding considerable stresses. For this purpose, the piston is integral with a rod the end of which positioned opposite the piston comprises a slide introduced into a guide which is part of the engine block and the geometrical axis of which coincides with that of the rod, the slide holding two shells which form a seat for a swivel joint connected by a neck to the above-mentioned swash plate and extending laterally with respect to the swash plate.

In an advantageous embodiment, the guide is composed of a cylinder having a first slot parallel to the geometrical axis of the cylinder, intended for the passage of the neck of the above-mentioned swivel joint, held between the two above-mentioned shells. The slide is advantageously composed of a cylindrical piece having a centre seat in which the two above-mentioned shells are mounted for sliding.

One detail of this invention is that the slide is provided on the side opposite the above-mentioned first slot with an axle provided with a roller at its end, and during the reciprocating translational movements of the piston, the said axle passes through a second slot provided in the wall of the guide in a manner which is diametrically opposite with respect to the first slot and the roller is retained between two guidance sections outside the said cylinder.

The present invention also provides a swash plate which is capable of withstanding very great stresses in a motor of the type concerned in this invention. For this purpose, the swash plate according to the present invention comprises a crown which carries externally at least one, but preferably two or four, swivel joint, each of which is arranged to rest on a piston driven by a linear and reciprocating movement, and of a central casing having a bore, the geometrical axis of which forms an angle with the plane of symmetry of the above-mentioned crown, the central casing mentioned above being rotatably mounted with respect to the crown, either by means of two needle bearings or by means of two smooth shoe rings which are lubricated hydrodynamically, the said bearings or shoes being positioned on both sides of the crown to allow the crown to rotate with respect to an annular element mounted on this casing.

Other details and characteristics of this invention will be revealed from the following description of a motor and a swash plate which is to be provided in a motor of this type.

This description is only provided by way of example and does not restrict the invention. The reference numerals refer to the accompanying drawings.

DETAILED DESCRIPTION

Figure 1:
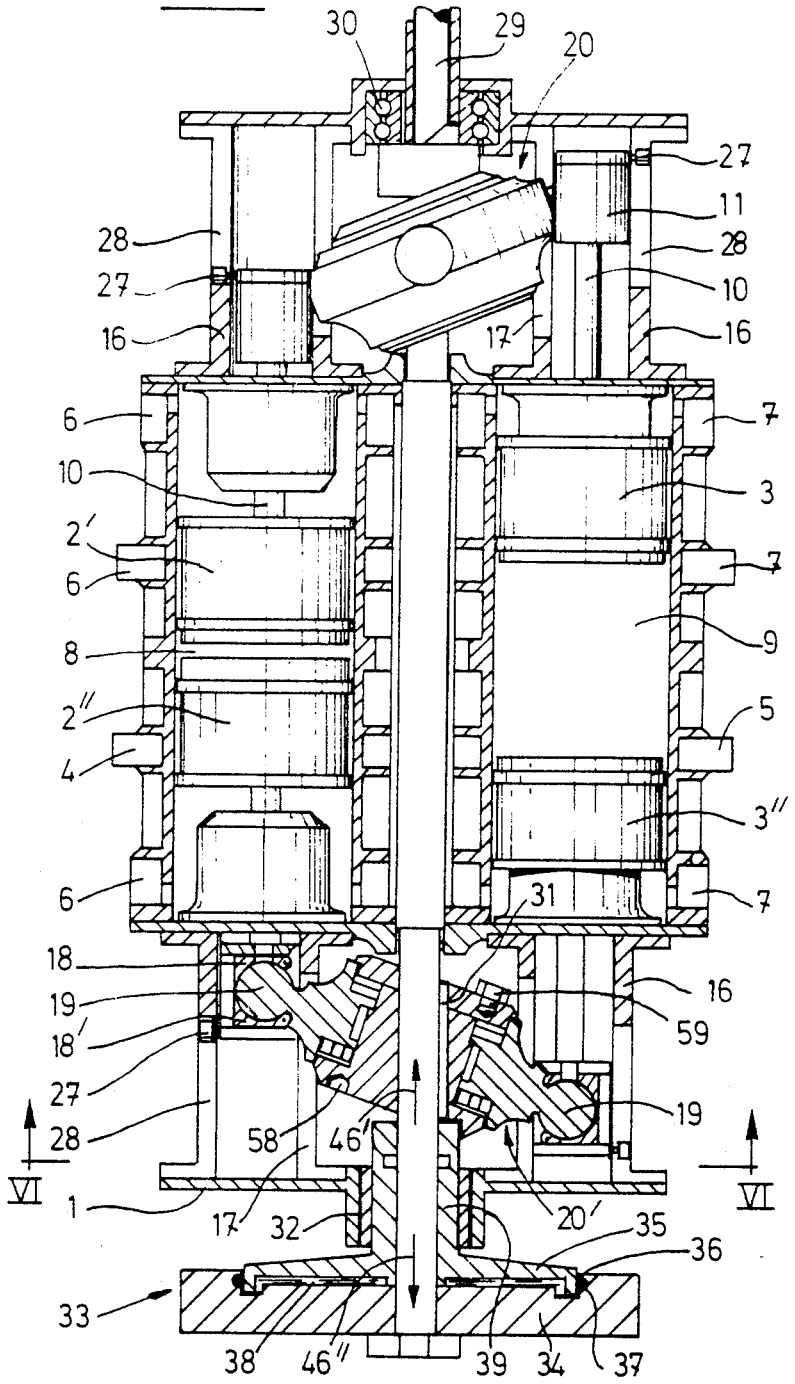
FIG. 1 is a partly longitudinal sectional view and partly elevational view of a motor according to the present invention.
Figure 6:
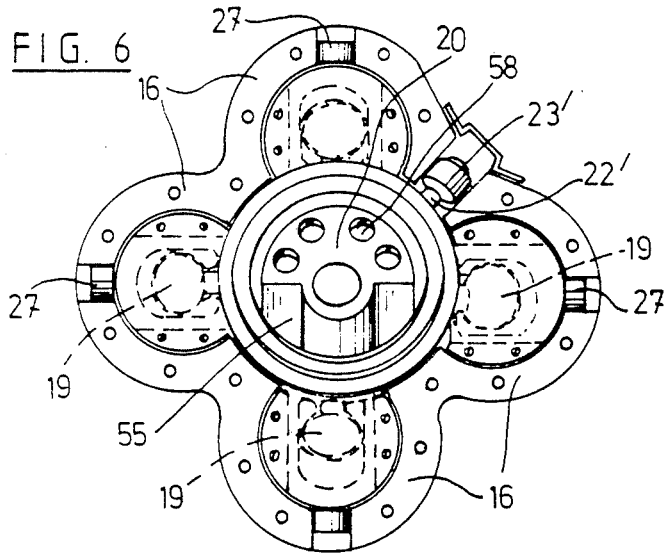
FIG. 6 is a section along line VI—VI of FIG. 1.

The motor illustrated in FIG. 1 comprises an engine block provided with two pairs of cylinders arranged in revolver-barrel-form as illustrated in FIG. 6. Each cylinder contains two opposite pistons such as 2', 2'' or 3', 3'' which may be seen in FIG. 1. Reference numerals 6 and 7 denote the admission ports of the two cylinders and reference numerals 4 and 5 denote the exhaust ports. The ports 4 and 5 open out onto a common collector. The ports 6 and 7 open out onto a common collector per cylinder.

The gaseous mixture in each of the chambers 8 or 9 is burnt by known means which are not described here, since the type of combustion is not relevant to the object of the present invention.

In order to obtain a strict linearity of the movements of the pistons, each piston is rigidly connected to a rod 10. The opposite end of this rod 10 comprises a slide 11 introduced into a guide 16 which may, in practice, be part of the engine block. The assembly of the slide 11 is illustrated in particular in the exploded view of FIG. 2.

Figure 2:
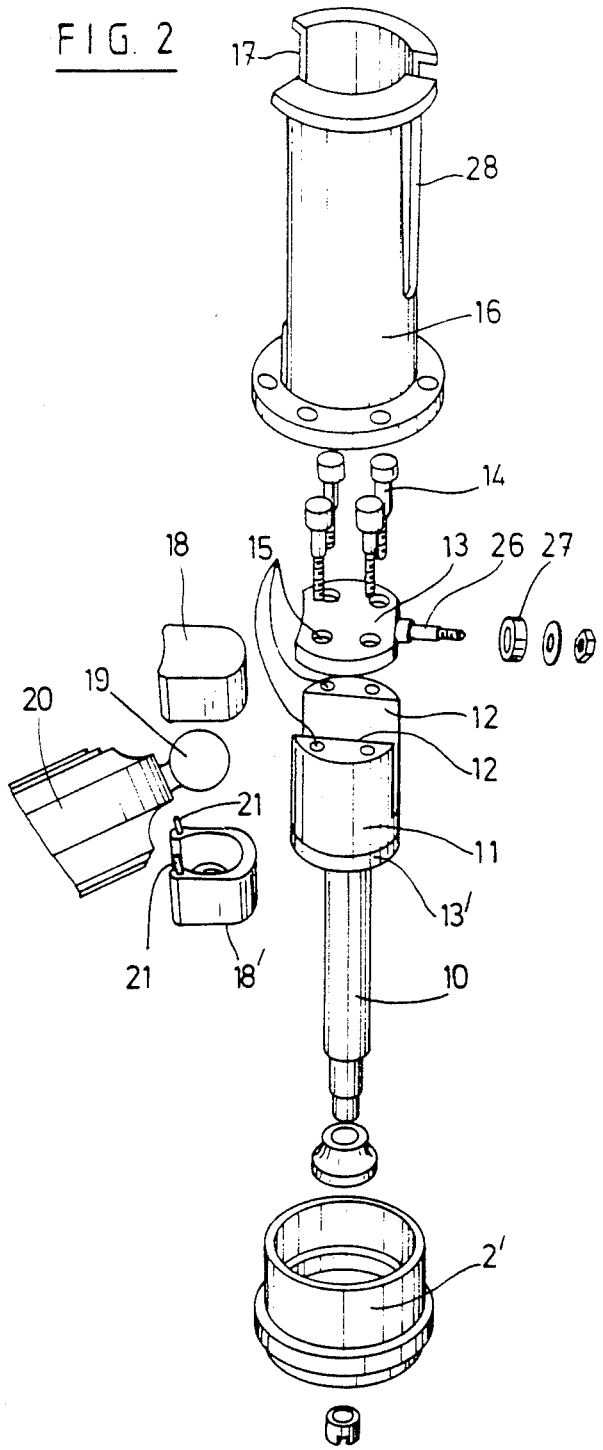
FIG. 2 is an exploded view illustrating a piston and its guidance system in a cylinder which is part of the engine block and the lateral part of the swash plate according to the invention.

While referring to FIG. 2, it may be seen that the slide 11 has a central seat providing two parallel walls 12 and terminated by a cover 13 attached onto the slide 11 by four screws 14 which pass through four openings 15 and are screwed into the plate 13'. Shells 18 and 18' are positioned in the central seat of the slide 11 and these shells hold a swivel joint 19 of the swash plate 20. The width of the seat between the faces 12 of the slide is equal to, if not slightly greater than the width of the shells 18 and 18'. These shells fit onto each other by means of nipples 21 provided on one of the shells which fit in the openings (not visible in the drawing) provided in the other shell. The shells 18 and 18' slide without clearance along the faces 12 of the seat of the slide 11.

Figure 3:
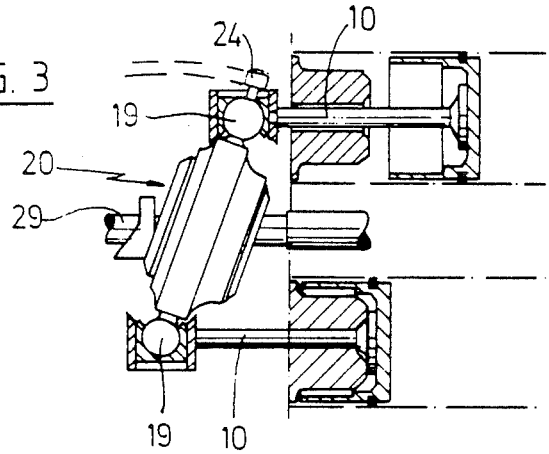
FIG. 3 is a schematic view illustrating the course of a roller mounted on an axle positioned in the geometrical axis connecting the two swivel joints of the same plate.

The slide 11 is introduced into a cylinder 16 which may, in practice, form a cylindrical cavity of the engine block. The cylinder 16 has a first slot 17 which is wide enough to allow the movement of the swash plate. If the swash plate is provided with one or two swivel joints, the movement of the swash plate is effected in a single plane passing through the plane of symmetry of the seat and thus through the geometrical axis of the rod 10 (cf. FIG. 3).

Figure 7:
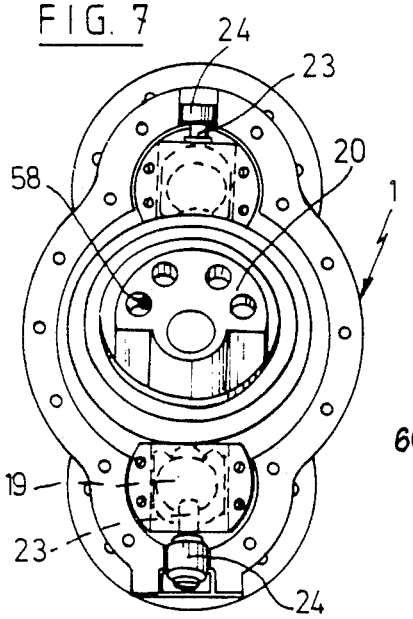
FIG. 7 is a similar section, but it refers to a swash plate having two swivel joints.

In order to prevent the swash plate 20 from rotating about its geometrical axis, the plate is provided with a roller co-operating with a guidance means. If the swash plate is provided with two swivel joints as in the motor illustrated, for example, in FIG. 7, an axle 23 (FIG. 4) provided with a roller 24 is mounted on a swivel joint 19 and the roller is held in order to revolve between two guidance sections 25. If the swash plate is provided with four swivel joints as illustrated in FIG. 5, the roller may be mounted on the plate between two swivel joints 19. FIG. 5 illustrates the position of the roller 24' mounted on the axle 23'.

Rotation of a piston is prevented by an axle 26 which is on the cover 13 of the slide 11 and is provided with a roller 27 held between the opposite faces of the narrow longitudinal slot 28 provided in the cylinder 16 in a position which is diametrically opposite that of the wide slot 17.

With reference to FIG. 1, it may be seen that the swash plate 20 is secured on a shaft 29 in a ballbearing or in a smooth ring bearing which is lubricated hydrodynamically. The lower swash plate 20' illustrated in section in FIG. 1, is mounted on the same shaft 29, but according to an assembly which prevents it from rotating with respect to the shaft but does not prevent a certain longitudinal sliding movement. An assembly of this type which is known per se is obtained due to the presence of a rib or key 31 provided on the shaft 29 to co-operate with a hollowing in the elements forming the swash plate 20'.

This plate which is composed of the same elements as the swash plate 20 will be described in detail later on and it is an essential element of the present invention.

Opposite the stationary bearing 30, the driving axle 29 is mounted by means of a sliding bearing 32 in the opposite face of the driving unit 1. This end of the shaft 29 is provided with a flywheel which is generally denoted with reference numeral 33 and is composed of two coaxial elements 34 and 35. The element 34 attached on the shaft 29 has a circular groove 36 for the circular edge 37 of the element 35 of the flywheel 33.

In contrast with the element 34 of the flywheel, the element 35 may slide slightly along the shaft 29 due to an assembly known per se, but it cannot be rotated with respect to this shaft. The rotation of the shaft 29 is integral with that of the element 35 of the flywheel 33.

There is a space 38 between the elements 34 and 35 of the flywheel 33 for a hydraulic liquid, the pressure of which may be increased or reduced as required. By increasing the pressure of the hydraulic liquid in the space 38, the cylindrical body 39 acts on the swash plate 20'. In fact, it is established that the centre part of the swash plate 20' abuts the transverse face of the cylindrical body 39 which is an integral part of the flywheel element 35.

It will be easily understood that by varying the volume of the space 38, the inclined plate 20' is acted on in the direction of the arrows 46' or 46'' to vary the compression between the pistons 2, 2' and 3, 3'. In order to achieve this objective, it suffices to provide a hydraulic pressure-tight joint between the circular edge 37 and one or more faces of the circular groove 36 of the flywheel element 34.

Figure 9:
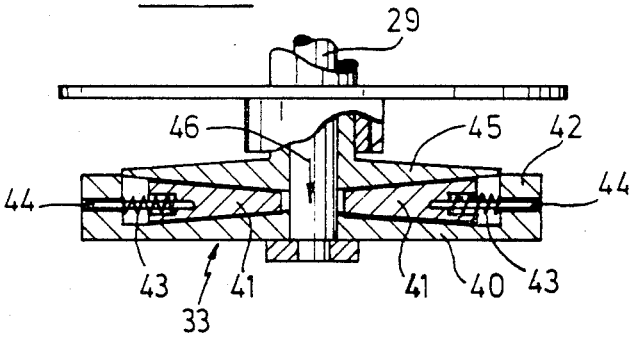
FIG. 9 refers to a flywheel with centrifugal runners in a radial sectional view.

Another design is illustrated in FIG. 9, with which it is possible to automatically regulate the ratio between the compression rate and the number of revolutions of the driving shaft.

The flywheel, denoted by the general reference numeral 33, is also composed of two elements, of which the element which is stationary with respect to the shaft 29 is denoted by reference numeral 40. This flywheel element 40 is provided with a series of runners 41 positioned in a circle inside the edge 42 of the element 40. Each runner is subjected to the action of a spring 43 wound round a rod 44 which is also used for guiding the corresponding runner.

The runners 41 are wedge-shaped and the large base of the wedge is directed towards the periphery of the flywheel 40, i.e. towards the edge 42 of the flywheel element 40.

The flywheel element 45 which is made to rotate by the shaft 29 may perform a certain longitudinal movement with respect to this shaft, due to a design which is, moreover, known per se.

Due to the centrifugal force, the runners are driven back outwards against the springs 43 and a displacement then follows, according to arrow 46 (FIG. 9). Consequently, when there is an increase in the number of revolutions of the shaft 29, a decrease in the compression rate is established between the pistons which operate in opposition and inversely. In fact, the cold starting operation is facilitated due to the fact that the volumetric ratio is improved. At a higher rate, it is possible to provide a supercharging of greater thrust.

It will be noted from the description which has just been given that the guidance means of the pistons 2', 2'' and 3', 3'' ensure a strict linearity in the reciprocating displacement of the slides 11 which are displaced inside the guides composed of the cylinders 16 or of the analogous cylindrical cavities which are part of the engine block. This strict linearity is ensured due in particular to the design of the assembly, between shells, of the swivel joints 19 of the swash plates 20 or 20'. When a swash plate is provided with only two swivel joints, the oscillating movement of the swivel joints strictly takes place in a single plane including the geometrical axis of the shaft 20 and the geometrical axis of the piston rods 10. However, when a swash plate is provided with four swivel joints, each of these joints follows a non-planar trajectory. When a swash plate having four swivel joints is used, no clearance is observed inside the seat 12 between the base of this seat, forming the base of the slide, and the lower face of the cover 13 (FIG. 2). On the other hand, a clearance does exist between the parallel faces 12 of the seat and there is also a reciprocating or translational movement inside this seat as may easily be imagined, due to the ascending and descending movements of each of the swivel joints 19 inside each of the corresponding seats of the slides 11.

Such is the design of the swash plates 20–21 that they may be subjected to extremely demanding stresses without the danger of fatigue which would result in premature wear of their constitutive elements. These stresses arise from the stresses exerted on the swivel joints 19 by the slides 11, the rods 10 and the various pistons 2', 2'' and 3', 3''.

Figure 8:
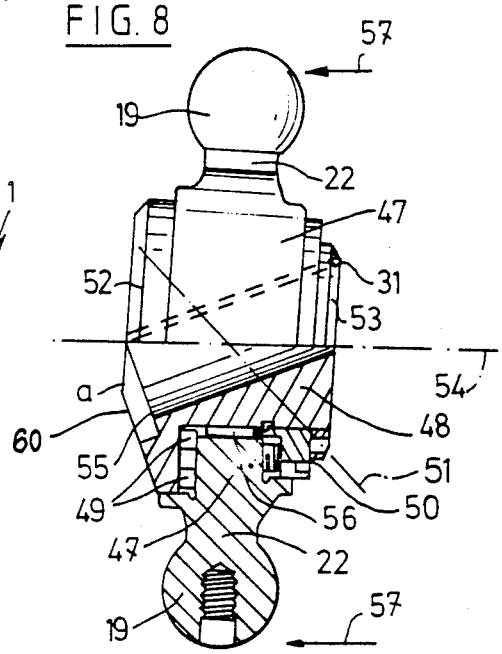
FIG. 8 is a section on a larger scale of a swash plate, the section including the geometrical axis of the plate.

While referring more particularly to FIG. 8, it will be noted that the swash plate is composed of a crown 47 supporting at least two swivel joints 19 which are diametrically opposite and are connected to the crown 47 by a collar 22. The crown 47 is mounted on a central casing 48 by a first needle bearing 49 and by a second needle bearing 50. The needle bearing 50 is held in position on the corresponding lateral flank of the crown 47 by a circular element 51.

The cylindrical elements which form the needle bearing 49 are composed alternatively of two and three coaxial elements. This arrangement is provided in order to accomodate variations in angular velocity which these elements undergo when the rotation of the central casing 48 with respect to the crown 47 is considered.

The bearing elements denoted above by the reference numerals 49 and 50 may be advantageously replaced by soe elements sliding on a hydrodynamic film of oil.

The central casing 48, of which the internal diameter of the centre bore corresponds to the external diameter of the shaft 29, has two external flanks 52 and 53 which are parallel to each other and to the plane of symmetry of the crown 47 level with the axis line 54. However, where the swash plate comes into contact with the cylindrical body 39 of the flywheel, in the case of that swash plate which, according to FIG. 1, co-operates with the mobile flywheel element 35, the flank 52 of the central casing is intersected by a plane which extends at a right angle with respect to the geometrical axis of the shaft 39. In FIG. 8, this plane is denoted by reference numeral 55. The part of this plane which is in permanent contact with the external face of the cylindrical body 39 is indicated in solid lines, while reference numeral 60 indicates a parallel plane formed according to an angle $\alpha$ with respect to the external flank 52. FIG. 8 also illustrates the rib 31 which drives the central casing 48 of the swash plate and allows the assembly to be displaced axially with respect to the shaft 29.

A third needle bearing or, in the case of pressurized lubrication, a smooth bearing forming a circular crown inside the crown 47 is represented by one of these elements with reference numeral 56. Balancing means composed of the openings 58 on one side and of bolts 59 on the other side are provided in the external flanks 52 and 53 of the central ring 48.

It will be realised from the description of the swash plate according to the present invention which has just been provided that this plate has all the qualities of compactness and thus of strength which are necessary to allow the very considerable stresses to be transmitted from the pistons of the motor and via the swivel joints 19 to the central casing 48 mounted on the shaft 29 in order to initiate the rotation of said shaft.

The stresses to be exerted by the various pistons on the swash plate illustrated in FIG. 8 and assumed to be the lower swash plate of FIG. 1 are exerted on the swivel joints 19 in the direction indicated by the arrows 57.

Figure 4:
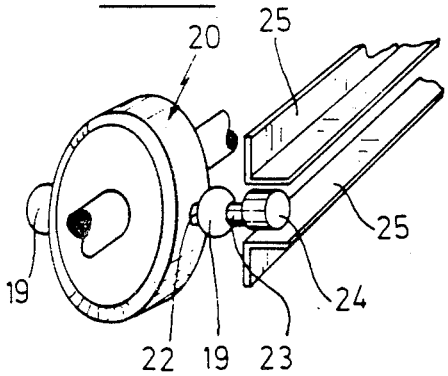
FIG. 4 is a schematic perspective view of a plate provided with two swivel joints and a roller revolving between two guidance sections.
Figure 5:
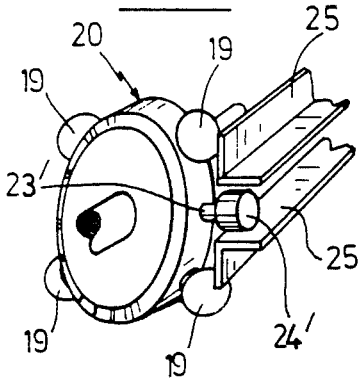
FIG. 5 is a similar view of a variation in which the swash plate is provided with four swivel joints.

In FIG. 8, one of the swivel joints 19 has an axial and tapped bore into which an axle 23 may be screwed which carries a roller 27 as in FIG. 4.

Of course, the present invention is not restricted to the above-described embodiment and modifications may be made without departing from the frame of the present invention.

What I claim is:

1. An engine comprising engine block means, at least a pair of parallel cylinders defined in said engine block means, each cylinder housing a different respective piston means which moves in a reciprocating, linear, and translational manner along a piston axis relative to said engine block means, a drive shaft extending parallel to and symmetrically disposed with respect to said cylinders, including bearing means journaling said drive shaft for rotational movements, said drive shaft having opposed ends, and a shaft axis, a rigid extension means associated with each said respective piston means and extending from each said cylinder parallel to said piston axis, each said extension means terminating in a slide means which reciprocates with its associated said respective piston means relative to said engine block means, guide means in said engine block means for said slide means, flywheel means disposed at one of said opposed shaft ends, and a swash plate assembly comprised of crown means disposed in circumferential relationship to said drive shaft, a pair of swivel joint means associated with said plate means, and each individual swivel joint means and said pair being in diametrically opposed relationship to the other thereof across said shaft axis, each one of said swivel joint means being functionally associated with a different one of said slide means, central casing means disposed generally transversely in said crown means and having bearing means, said bearing means mounting said central casing means for rotational movement of said central casting means relative to said crown means, said central casing means having a longitudinal axis, said central casing means including bore means extending angularly therethrough relative to said longitudinal axis, said bore means including keying means, and said drive shaft extending through said bore means, said keying means cooperating with said drive shaft in a driving relationship, said flywheel means being composed of two concentric elements, of which one such concentric element is positioned adjacent said engine block means while the other such concentric element includes a central cylindrical body which bears on said swash plate, and means is provided to vary the spacing between such two concentric elements of said flywheel, one of said two concentric elements being attached onto said drive shaft and the other of said concentric elements being adapted to slide axially on said drive shaft, whereby a variable volumetric cavity is definable between such two concentric elements which cavity can be varied volumetrically so that the volume of a combustion chamber defined in each cylinder is variable, whereby rocking movements of said swash plate assembly produces rotary movement of said shaft means.

2. An engine according to claim 1, wherein said cavity is subjectable to a variable hydraulic pressure to vary the volume of said cavity.

3. An engine according to claim 1, wherein said cavity is provided with centrifugal runners in the form of wedges, the base of the wedges being directed outwards, whereas the internal surfaces of the flywheel elements facing each other are inclined with respect to said drive shaft at an angle which corresponds to the conicity of said runners, the relationship being such that the increase in the centrifugal force acting on the above-mentioned runners causes such flywheel elements to approach each other and thus causes an increase in volume of said combustion chamber in said cylinder.

4. An engine comprising engine block means, at least a pair of parallel cylinders defined in said engine block means, each cylinder housing a different respective piston means which moves in a reciprocating, linear, and translational manner along a piston axis relative to said engine block means, a drive shaft extending parallel to and symmetrically disposed with respect to said cylinders, including bearing means journaling said drive shaft for rotational movements, said drive shaft having opposed ends, and a shaft axis, a rigid extension means associated with each said respective piston means and extending from each said cylinder parallel to said piston axis each said extension means terminating in a slide means which reciprocates with its associated said respective piston means relative to said engine block means, guide means in said engine block means for said slide means, flywheel means disposed at one of said opposed shaft ends, and, a swash plate assembly comprised of crown means disposed in circumferential relationship to said drive shaft, a pair of swivel joint means associated with said swash plate means, and each individual swivel joint means of said pair being in diametrically opposed relationship to the other thereof across said shaft axis, each one of said swivel joint means being functionally associated with a different one of said slide means, central casing means disposed generally transversely in said crown means and having bearing means, said bearing means mounting said central casing means for rotational movement of said central casting means relative to said crown means, said central casing means having a longitudinal axis, said central casing means including bore means extending angularly therethrough relative to said longitudinal axis, said bore means including keying means, and said drive shaft extending through said bore means, said keying means cooperating with said drive shaft in a driving relationship, said guide means comprising a cylinder having a first slot therein parallel to said piston axis of the said cylinder, and adapted for reciprocal movement of a neck of each one of said swivel joint means, slide means opposie said first slot in said guide means and a shaft is provided which has at its end a roller, and wherein a second slot in said guide means is provided for said slide means in a diametrically opposite relationship to the first slot, said roller being guided along said second slot by said shaft during the course of reciprocating translational movements of the said piston.

5. The swash plate assembly according to claim 4 wherein said crown means is provided with a second pair of said swivel joint means.

6. The swash plate assembly according to claim 4 wherein said central casing means is provided with balancing means.

* * * * *